US007146696B2

(12) United States Patent
Lee

(10) Patent No.: US 7,146,696 B2
(45) Date of Patent: Dec. 12, 2006

(54) STAPLING DEVICE

(75) Inventor: Pei-Yuan Lee, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 677 days.

(21) Appl. No.: 10/355,546

(22) Filed: Jan. 31, 2003

(65) Prior Publication Data

US 2004/0120795 A1 Jun. 24, 2004

(30) Foreign Application Priority Data

Jun. 18, 2002 (TW) ..... 91113307 A

(51) Int. Cl.
*B42C 1/00* (2006.01)

(52) U.S. Cl. ..... 29/33 R; 412/33; 412/40; 425/392

(58) Field of Classification Search ..... 412/33, 412/43, 28, 38, 39, 40; 425/391, 392
See application file for complete search history.

(56) References Cited

U.S. PATENT DOCUMENTS 3,122,761 A * 3/1964 Bonvier ..... 412/40
3,699,596 A 2/1972 Lyon
4,008,501 A 2/1977 Cutter
5,007,782 A * 4/1991 Groswith et al. ..... 412/40
5,143,502 A * 9/1992 Kaufmann et al. ..... 412/16
5,273,387 A 12/1993 Groswith, III et al. ..... 412/40
5,615,986 A * 4/1997 Cox ..... 412/40
5,971,689 A * 10/1999 Scharer et al. ..... 412/33

* cited by examiner

*Primary Examiner*—Monica Carter
*Assistant Examiner*—Sara Addisu

(57) ABSTRACT

A stapling device for binding an article having a hole structure with a stapling medium having a loop structure corresponding to the hole structure is provided. The stapling device includes a supporting portion, a movable portion and a transmission portion. The supporting portion is used for holding the stapling medium. The movable portion is disposed adjacent to the supporting portion and moved in a first direction to sustain against the loop structure and in a second direction to prop open the loop structure after the stapling medium is held by the supporting portion, thereby allowing the open loop structure to hook in the hole structure of the article. The transmission portion is coupled to the movable portion, and transmits the movable portion to move in the first direction and the second direction in response to a force exerted thereon.

14 Claims, 5 Drawing Sheets

STAPLING DEVICE

FIELD OF THE INVENTION

The present invention relates to a stapling device, and more particularly to a stapling device for binding a stack of paper sheets.

BACKGROUND OF THE INVENTION

Stapling devices have been widely used to bind a stack of punched paper sheets with a plastic resilient loop structure. The plastic resilient loop structure includes a plastic strip integrally formed thereon a plurality of curled loops in number corresponding to the holes in an edge margin of the punched paper sheets. A conventional stapling device is shown in FIG. 1(*a*), which is referred to U.S. Pat. No. 5,273,387. The stapling device principally comprises a punching mechanism 10, a finger structure 11, a fixture plate 12 and a knob 13. By means of the punching mechanism 10, a plurality of holes are created in an edge margin of a stack of paper sheets to be bound together. The principle and operation of the punching mechanism are well known in the art and need not be further described in detail herein. The finger structure 11, the fixture plate 12 and the knob 13 are cooperated for inserting resilient curled loops 141 formed on a plastic skeleton strip 14, as shown in FIG. 1(*b*), into the holes of the paper sheets so as to bind the paper sheets. In order to achieve this purpose, the plastic strip 14 is placed in a position behind the fixture plate 12. Then, the user manually shifts the plastic strip 14 to the right such that the cantilevered end of each finger penetrates the center of the corresponding curled loop 141. Then, the knob 13 is rotated to move the finger structure 11 outwardly from the fixture plate 12 until all the resilient curled loops 141 are propped open by the cantilevered ends of the finger structure 11. Then, the stack of paper sheets (not shown) are threaded by receiving the uncurled loops 141 via the pre-punched holes on the edge thereof. Subsequently, the knob 13 is rotated in the opposite direction to push the finger structure 11 back to its original position, and thus the resilient loops 141 are re-curled to bind the paper sheets.

The stapling device described above has some disadvantages. For example, it is difficult to manually move the plastic strip 14 because the plastic strip 14 is placed behind the fixture plate 13. In addition, the plastic strip 14 is readily slack and likely to become distorted once being exerted thereon an uneven force. After the paper sheets are completely threaded with the resilient loops 141, the plastic strip 14 is moved out from the stapling device to release the paper sheets by being manually shifted to and fro. This procedure for taking out the bound paper sheets is user-unfriendly.

SUMMARY OF THE INVENTION

It is an object of the present invention to provide a stapling device for binding a stack of paper sheets by mechanically shifting the plastic strip so as to precisely position the plastic strip and avoid its distortion.

In accordance with an aspect of the present invention, there is provided a stapling device for binding an article having a hole structure with a stapling medium having a loop structure corresponding to the hole structure. The stapling device comprises a supporting portion, a movable portion and a transmission portion. The supporting portion is used for holding the stapling medium. The movable portion is disposed adjacent to the supporting portion and moved in a first direction to sustain against the loop structure and in a second direction to prop open the loop structure after the stapling medium is held by the supporting portion, thereby allowing the open loop structure to hook in the hole structure of the article. The transmission portion is coupled to the movable portion, and transmits the movable portion to move in the first direction and the second direction in response to a force exerted thereon.

In an embodiment, the article is a stack of paper sheets.

In an embodiment, the loop structure of the stapling medium includes a plurality of substantially parallel resilient curled loops. The first direction is an axial direction of the substantially parallel resilient curled loops, and the second direction is a radial direction of the substantially parallel resilient curled loops.

In an embodiment, the stapling medium is a plastic strip with a plurality of substantially parallel resilient curled loops, and the movable portion is a movable plate with protrudent fingers for manipulating the resilient curled loops. The protrudent fingers have cantilevered ends.

In an embodiment, the supporting portion comprises a supporting base for placing thereon the plastic strip, and a plurality of posts protruding from the supporting base to prevent the plastic strip from escaping from the supporting portion. There is a clearance between two adjacent ones of the posts for receiving one of the portrudent fingers therein and allowing the one of the protrudent fingers to move in the first direction and the second direction within the clearance.

In an embodiment, the movable portion further comprises a first slot and a second slot. The first slot has therein a first rack for cooperating with the transmission portion to move the movable portion in the first direction. The second slot is in communication with the first slot, and has therein a second rack for cooperating with the transmission portion to move the movable portion in the second direction.

In an embodiment, the transmission portion comprises a gear assembly and a knob. The gear assembly has a first tooth element engaging with the first rack to move the movable portion in the first direction and engaging with the second rack to move the movable portion in the second direction. The knob is coupled to the gear assembly for being exerted thereon the force so as to drive the gear assembly to rotatably move along the first rack and then the second rack.

Preferably, the first and the second slots are arranged as an L-shape.

In an embodiment, the movable portion further comprises a third slot and a fourth slot. The third slot has therein a third rack for cooperating with the first slot and the transmission portion to move the movable portion in the first direction. The fourth slot is in communication with the third slot, and has therein a fourth rack for cooperating with the second slot and the transmission portion to move the movable portion in the second direction. Moreover, the transmission portion comprises a first gear assembly, a second gear assembly, a knob and a linking element. The first gear assembly has a first tooth element engaging with the first rack to move the movable portion in the first direction and engaging with the second rack to move the movable portion in the second direction. The second gear assembly has a second tooth element engaging with the third rack to move the movable portion in the first direction and engaging with the fourth rack to move the movable portion in the second direction. The knob is coupled to the first gear assembly for being exerted thereon the force so as to drive the first gear assembly to rotatably move along the first rack and then the second rack. The linking element is connected between the first and the second gear assemblies for allowing the second gear assembly to move with the first gear assembly so as to engage with the third rack to move the movable portion in the first direction and engage with the fourth rack to move the movable portion in the second direction.

In an embodiment, the linking element is a linking bar.

In an embodiment, the stapling device of the present invention further comprises a chassis portion for accommodating the transmission portion, and there is a gap in the chassis portion for receiving therein the linking bar.

In accordance with another aspect of the present invention, there is provided a stapling device for binding an article having a hole structure with a stapling medium having a loop structure corresponding to the hole structure. The stapling device comprises a supporting portion, a movable portion and a transmission portion. The supporting portion is used for holding the stapling medium. The movable portion comprises a first slot having therein a first rack and a second rack. The transmission portion comprises a gear assembly having a first tooth element for engaging with the first rack to move the movable portion in a first direction so as to sustain against the loop structure and engaging with the second rack to move the movable portion in a second direction so as to prop open the loop structure, thereby allowing the open loop structure to hook in the hole structure of the article.

In an embodiment, the first and the second rack are arranged as an L-shape.

In an embodiment, the movable portion further comprises a second slot having therein a third rack and a fourth rack arranged as an L-shape, and the transmission portion further comprises another gear assembly having a second tooth element for engaging with the third rack to move the movable portion in the first direction and engaging with the fourth rack to move the movable portion in the second direction.

In an embodiment, the stapling device of the present invention further comprises a knob coupled to one of the gear assemblies and connected to the other via a linking bar for being exerted thereon the force so as to drive the gear assemblies to rotatably move along the first rack and then the second rack.

In accordance with another aspect of the present invention, there is provided a stapling device for binding a stack of paper sheets having a hole structure with a plastic strip having a loop structure corresponding to the hole structure, the stapling device. The stapling device comprises a supporting portion, a movable portion and a transmission portion. The supporting portion is used for holding the plastic strip. The movable portion comprises a first slot having therein a first rack and a second rack, and moved in a first direction to sustain against the loop structure and in a second direction to prop open the loop structure, thereby allowing the open loop structure to hook in the hole structure of the stack of paper sheets. The transmission portion comprises a gear assembly having a tooth element, and coupled to the movable portion by engaging the tooth element with either of the first and second racks, and transmitting the movable portion to move in the first direction and the second direction in response to a force exerted thereon.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a schematic diagram showing a plastic resilient loop structure for binding a stack of punched paper sheets;

DETAILED DESCRIPTION OF THE PREFERRED EMBODIMENT

Figure 1A:
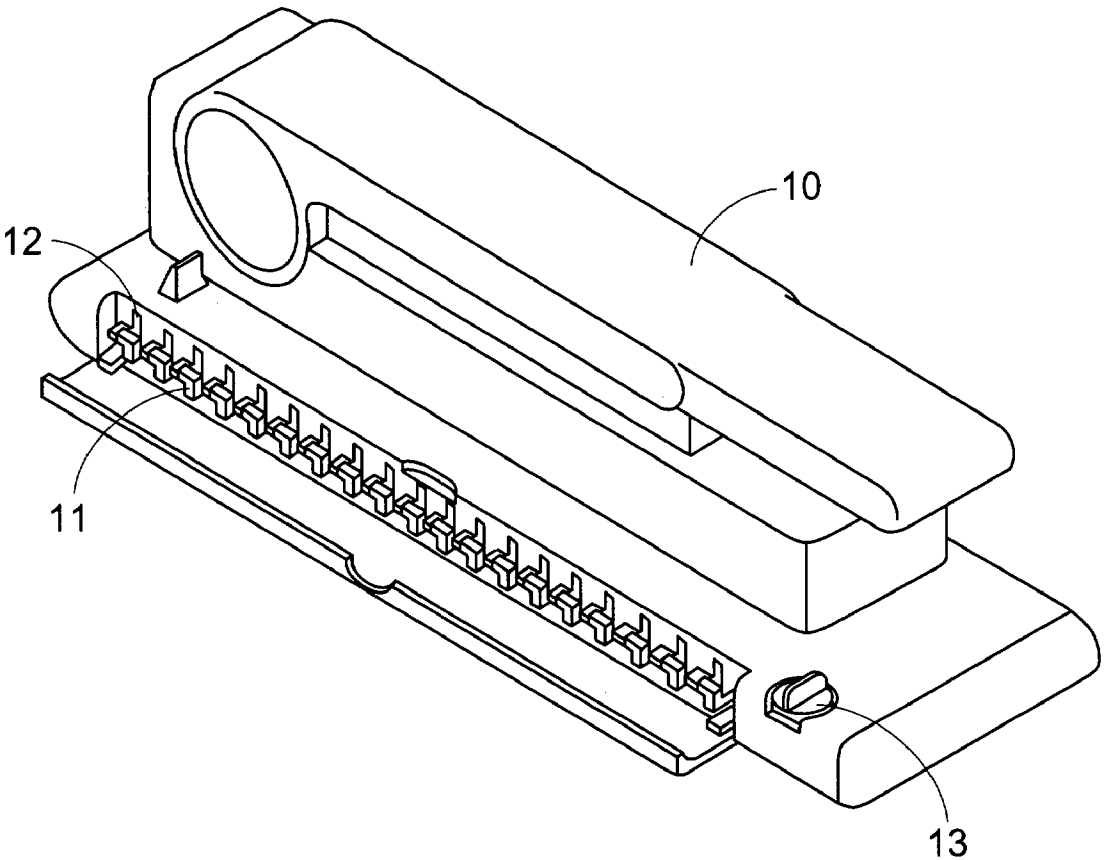
Fig.1(a) PRIOR ART
FIG. 1(*a*) is a perspective view schematically showing a conventional stapling device.
Figure 1B:
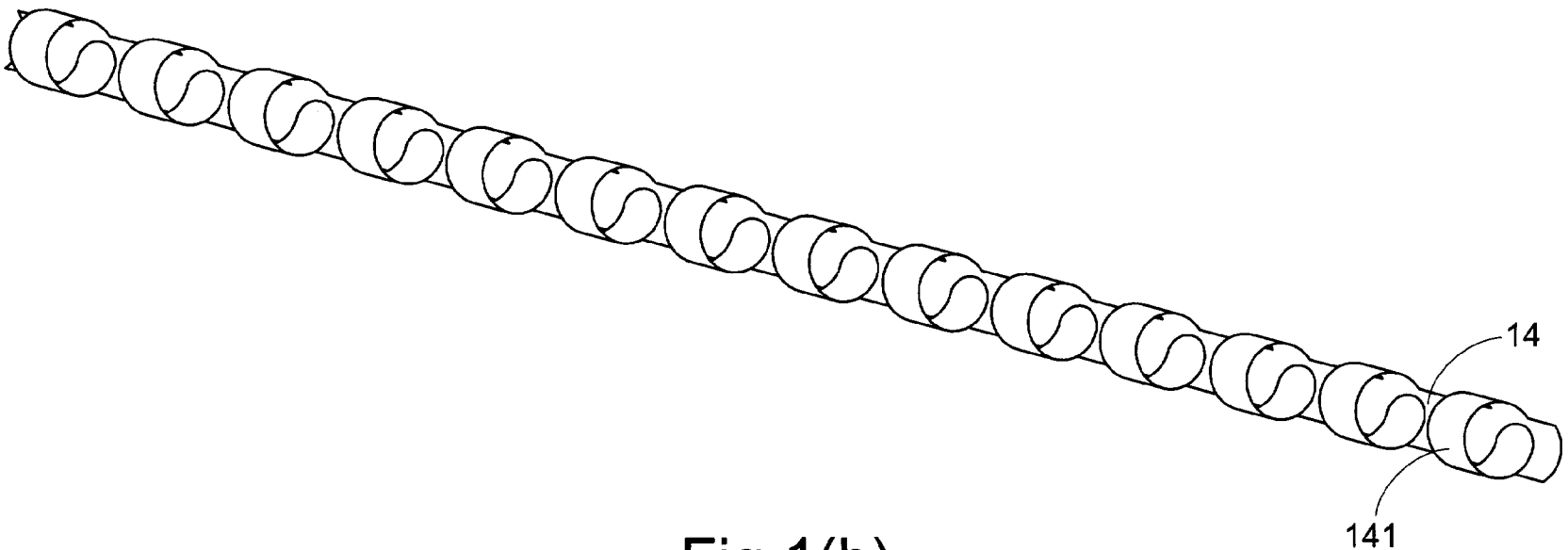
Figure 2:
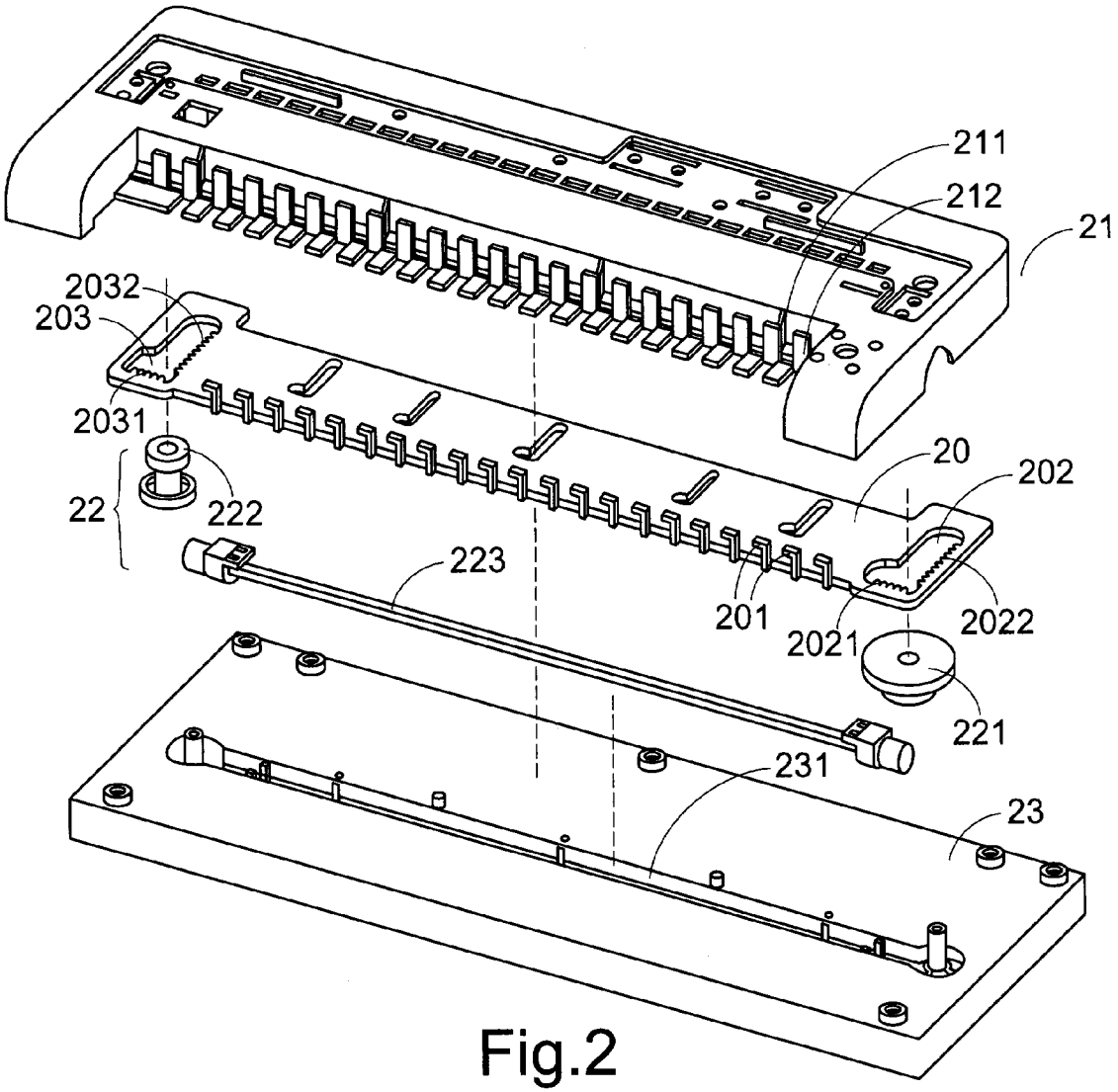
FIG. 2 is exploded view illustrating a stapling device according to a preferred embodiment of the present invention.

Please refer to FIG. 2, which is a schematic exploded view of a stapling device according to a preferred embodiment of the present invention. The stapling device is employed to bind a stack of punched paper sheets with a plastic resilient loop structure as described in FIG. 1(*b*). The plastic resilient loop structure includes a plastic strip integrally formed thereon a plurality of curled loops in number corresponding to the holes in an edge margin of the punched paper sheets. As shown in FIG. 2, the stapling device comprises a movable plate 20, a supporting structure 21, a transmission portion 22 and a chassis 23.

Figure 4:
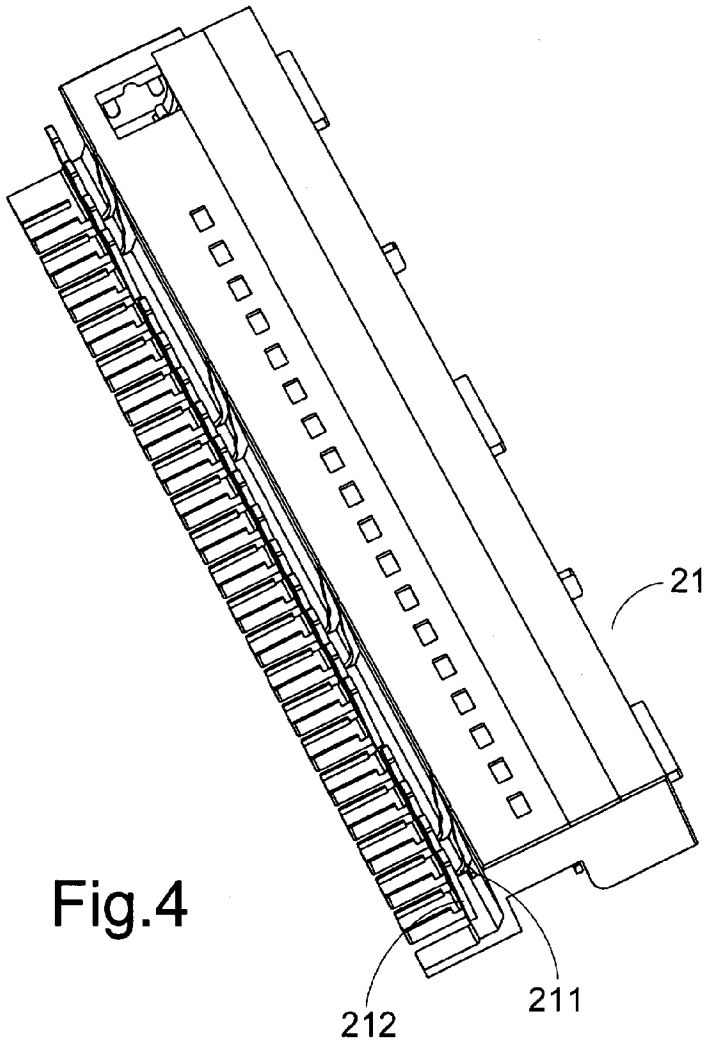
FIG. 4 is a top perspective view schematically showing a supporting structure of the present stapling device.

The supporting structure 21 comprises a supporting base 211 and a plurality of posts 212 protruding from the supporting base 211. The supporting base 211 is used for placing thereon the plastic strip. The protruding posts 212 facilitate clipping the plastic strip so as to prevent the plastic strip from escaping from the supporting structure 21. Between two adjacent ones of these posts 212, there is a clearance. In order to accommodate the plastic strip with various sizes, the supporting base 211 is preferably designed as a curve shape, as can also be seen in FIG. 4.

The movable plate 20 has a plurality of fingers 201 protruding from an edge thereof. Each finger 201 has a cantilevered end and will be received in the clearance between two adjacent posts 212 of the supporting structure 21 so as to manipulate the resilient curled loops of the plastic strip. The movable plate 20 further has two slots 202 and 203 disposed in opposite sides thereof. The slot 202 has therein a first rack 2021 and a second rack 2022 arranged as an L-shape for cooperating with the gear assembly 221 of the transmission portion 22 to move the movable plate 20 in an axial and a radial directions of the resilient curled loop structure, respectively. Likewise, the slot 203 has therein a third rack 2031 and a fourth rack 2032 arranged as an L-shape for cooperating with another gear assembly 222 of the transmission portion 22 to cooperate with the gear assembly 221 to move the movable plate 20 even smoothly.

Figure 3A:
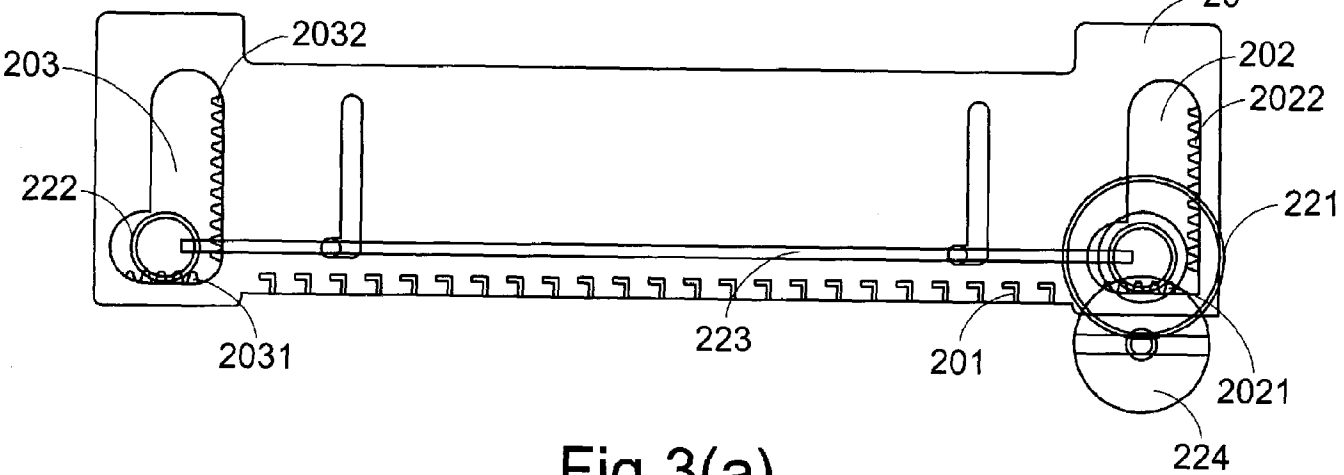
FIGS. 3(*a*) and 3(*b*) are top plane and front elevational views schematically showing a combination of a movable portion and a transmission portion of FIG. 2, respectively.
Figure 3B:
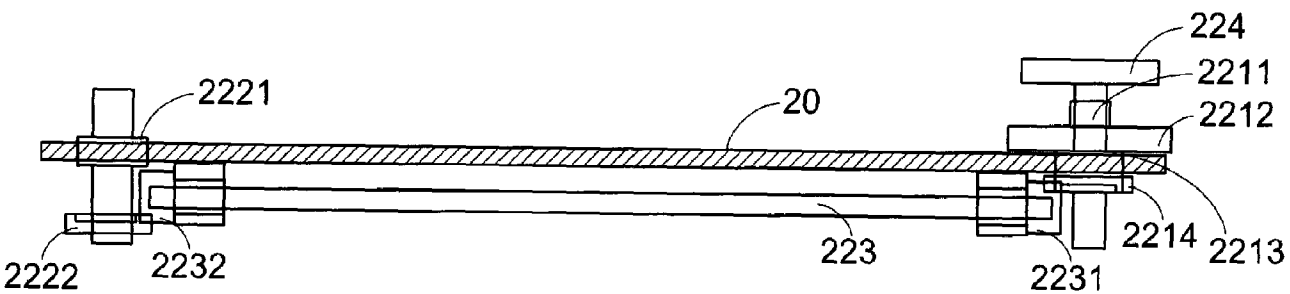

FIGS. 3(*a*) and 3(*b*) further illustrate the engagement and operation relationship between the movable plate 20 and the transmission portion 22. The transmission portion 22 is coupled to the movable plate 20 and transmits the movable plate 20 to move in the axial and the radial directions of the resilient curled loop structure in response to a force exerted thereon. The transmission portion 22 comprises the gear assembly 221, the gear assembly 222, a linking bar 223 connecting the gear assembly 222 with the gear assembly 221, and a knob 224 engaging with the gear assembly 221. As shown in FIG. 3(*b*), the first gear assembly 221 comprises a rolling gear 2211, a screw gear 2212, a spur gear 2213 and a coronal gear 2214. The second gear assembly 222 comprises a spur gear 2221 and a coronal gear 2222. The linking bar 223 has two spur gears 2231 and 2232 disposed at two ends thereof, respectively. The spur gears 2231 and 2232 of the linking bar 223 engage with the coronal gear 2214 of the first gear assembly 221 and the coronal gear 2222 of the second gear assembly 222, respectively. By exerting a rotating force on the knob 224, the gear assembly 221 is transmitted to rotate, and the spur gear 2213 of the first gear assembly 221 engages with the first rack 2021 and the second rack 2022 so as to move the movable plate 20 in the axial and the radial directions of the resilient curled loop structure. The rotation of the gear assembly 221 in response to the force exerted on the knob 224 also transmits the gear assembly 222 to rotate via the linking bar 223. Likewise, the spur gear 2221 of the second gear assembly 222 engages with the third rack 2031 and the fourth rack 2032 so as to move the movable plate 20 in the axial and the radial directions of the resilient curled loop structure.

Please refer to FIG. 2 again. The chassis 23 is used for accommodating the transmission portion 22, and there is a gap 231 in the chassis 23 for receiving therein the linking bar 223.

For further understanding the stapling device of the present invention, the operating procedures will be illustrated as follows in more details. Firstly, a plastic strip is placed on the supporting base 211. Then, by means of turning the knob 224, the first gear assembly 221 is driven to rotatably move along the first rack 2021. Meanwhile, the second gear assembly 222 is driven to rotatably move along the third rack 2031 by the transmission of the linking bar 223. By shifting the movable plate 20 to the left side, the cantilevered end of each finger 201 enters the corresponding curled loop structure. Then, the knob 224 is further rotated to move the movable plate 20 forwards, thereby propping open the resilient curled loop structure by the cantilevered ends of the fingers 201. Then, a stack of paper sheets (not shown) are placed within the uncurled loop structure, and aligning with the loops by the pre-punched holes on the edge thereof. Subsequently, the knob 224 is rotated in the opposite direction to push the movable plate 20 back to its original position, and thus the resilient loop structure are re-curled to bind the paper sheets.

Since the procedures for binding the paper sheets are implemented by mechanically shifting the plastic strip, the drawbacks of manually moving the plastic strip occurring in the prior art could be completely overcome. In other words, the plastic strip could be precisely positioned so as to avoid its distortion. Furthermore, the curved supporting base of the present stapling device facilitates placing thereon the plastic strip and taking out the bound paper sheets.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A stapling device for binding an article having a hole structure with a stapling medium having a loop structure corresponding to said hole structure, said stapling device comprising:

a supporting portion for holding said stapling medium;

a movable portion, having a first L-shaped slot and a second L-shaped slot, disposed adjacent to said supporting portion and moved in a first direction to sustain against said loop structure and in a second direction to prop open said loop structure after said stapling medium is held by said supporting portion, thereby allowing said open loop structure to hook in said hole structure of said article; and a transmission portion, having a first gear assembly, a second gear assembly and a linking element, coupled to said first and second L-shaped slots, and transmitting said first and second L-shaped slots to move in said first direction and said second direction in response to a force exerted thereon;

wherein said first L-shaped slot having therein a first rack and a second rack for cooperating with said first gear assembly to move said movable portion in said first direction and in said second direction, respectively;

said second L-shaped slot, connected to said first L-shaped slot by way of said linking element, having therein a third rack and a fourth rack for cooperating with said second gear assembly to move said movable portion in said first direction and in said second direction, respectively;

said first gear assembly having a first tooth element engaging with said first rack to move said movable portion in said first direction and engaging with said second rack to move said movable portion in said second direction;

said second gear assembly having a second tooth element engaging with said third rack to move said movable portion in said first direction and engaging with said fourth rack to move said movable portion in said second direction; and said linking element connected between said first and said second gear assemblies for allowing said second gear assembly to move with said first gear assembly so as to engage with said third rack to move said movable portion in said first direction and engage with said fourth rack to move said movable portion in said second direction.

2. The stapling device according to claim 1 wherein said article is a stack of paper sheets.

3. The stapling device according to claim 1 wherein said loop structure of said stapling medium includes a plurality of substantially parallel resilient curled loops.

4. The stapling device according to claim 3 wherein said first direction is an axial direction of said substantially parallel resilient curled loops.

5. The stapling device according to claim 4 wherein said second direction is a radial direction of said substantially parallel resilient curled loops.

6. The stapling device according to claim 1 wherein said stapling medium is a plastic strip with a plurality of substantially parallel resilient curled loops, and said movable portion is a movable plate with protrudent fingers for manipulating said resilient curled loops.

7. The stapling device according to claim 6 wherein said protrudent fingers have cantilevered ends.

8. The stapling device according to claim 6 wherein said supporting portion comprises:

a supporting base for placing thereon said plastic strip; and a plurality of posts protruding from said supporting base to prevent said plastic strip from escaping from said supporting portion, wherein there is a clearance between two adjacent ones of said posts for receiving one of said portrudent fingers therein and allowing said one of said protrudent fingers to move in said first direction and said second direction within said clearance.

9. The stapling device according to claim 1 wherein said transmission portion further comprises a knob coupled to said first gear assembly for being exerted thereon said force so as to drive said first gear assembly to rotatably move along said first rack and then said second rack.

10. The stapling device according to claim 9 wherein said linking element is a linking bar.

11. The stapling device according to claim 10 further comprising a chasis portion for accommodating said transmission portion, and there is a gap in said chasis portion for receiving therein said linking bar.

12. The stapling device according to claim 1 wherein said first gear assembly comprises a rolling gear, a screw gear, a spur gear engaged with said first L-shaped slot and a first coronal gear.

13. The stapling device according to claim 12 wherein said second gear assembly comprises a spur gear engaged with said second L-shaped slot and a second coronal gear.

14. The stapling device according to claim 13 wherein said linking element having two spur gears respectively disposed at two ends thereof and engaged with said first and second coronal gears, respectively.

* * * * *